US006396464B2

(12) United States Patent
Yokota et al.

(10) Patent No.: US 6,396,464 B2
(45) Date of Patent: May 28, 2002

(54) LIQUID-CRYSTAL DISPLAY CONTROL APPARATUS

(75) Inventors: Yoshikazu Yokota, Kodaira; Satoru Tsunekawa, Higashimurayama; Kimihiko Sugiyama, Tachikawa, all of (JP)

(73) Assignees: Hitachi, Ltd., Tokyo; Hitachi Device Engineering Co., Ltd., Chiba, both of (JP)

( * ) Notice: Subject to any disclaimer, the term of this patent is extended or adjusted under 35 U.S.C. 154(b) by 0 days.

(21) Appl. No.: 09/893,531

(22) Filed: Jun. 29, 2001

Related U.S. Application Data

(63) Continuation of application No. 09/369,121, filed on Aug. 5, 1999, now Pat. No. 6,259,421, which is a continuation of application No. 08/932,033, filed on Sep. 17, 1997, now Pat. No. 6,005,537, which is a continuation of application No. 08/308,830, filed on Sep. 19, 1994, now abandoned, which is a continuation of application No. 08/100,764, filed on Aug. 2, 1993, now abandoned.

(30) Foreign Application Priority Data

Aug. 21, 1992 (JP) ..... 4-222502
Jul. 20, 1993 (JP) ..... 5-179119

(51) Int. Cl.[7] ..... G09G 3/04
(52) U.S. Cl. ..... 345/33; 345/116; 345/192
(58) Field of Search ..... 345/1, 3, 33, 34, 345/50, 87, 98, 116, 141, 192–194, 199

(56) References Cited

U.S. PATENT DOCUMENTS 3,803,589 A 4/1974 Hatsukano et al.
4,224,615 A 9/1980 Penz
4,414,545 A 11/1983 Sakurada et al.
4,482,894 A 11/1984 Matsui et al.
4,616,336 A 10/1986 Robertson et al.
4,639,721 A 1/1987 Eto et al.
4,692,760 A 9/1987 Unno et al.
4,827,251 A 5/1989 Aoki et al.
4,845,477 A 7/1989 Shibata et al.
5,135,398 A 8/1992 Thornton et al.
5,159,324 A 10/1992 Ohtani et al.

FOREIGN PATENT DOCUMENTS

DE 3434118 3/1986
JP 3-229298 10/1991

*Primary Examiner*—Amare Mengistu
(74) *Attorney, Agent, or Firm*—Mattingly, Stanger & Malur, P.C.

(57) ABSTRACT

The liquid-crystal display control apparatus provided by the present invention comprises a display RAM unit 21 for storing character codes, character-generator RAM and ROM units 22 and 23 for storing character font patterns and a segment RAM unit 24 for storing picture patterns such as marks and icons. When displaying a character, the following display control is carried out. First of all, a character code is read out from the display RAM unit 21 at a display address generated by a display-address counter 25. The character code is then used in conjunction with a raster address output by a line-address counter 26 for reading out a character font pattern from the character-generator RAM unit 22 or the character-generator ROM unit 23. When displaying a picture pattern such as a mark or an icon, on the other hand, the following display control is carried out. Display control information is read out from the segment RAM unit 24 at an address generated by the display-address counter 25. Dot-matrix characters and picture patterns such as marks and icons are displayed on the same screen on a time-division basis.

20 Claims, 4 Drawing Sheets

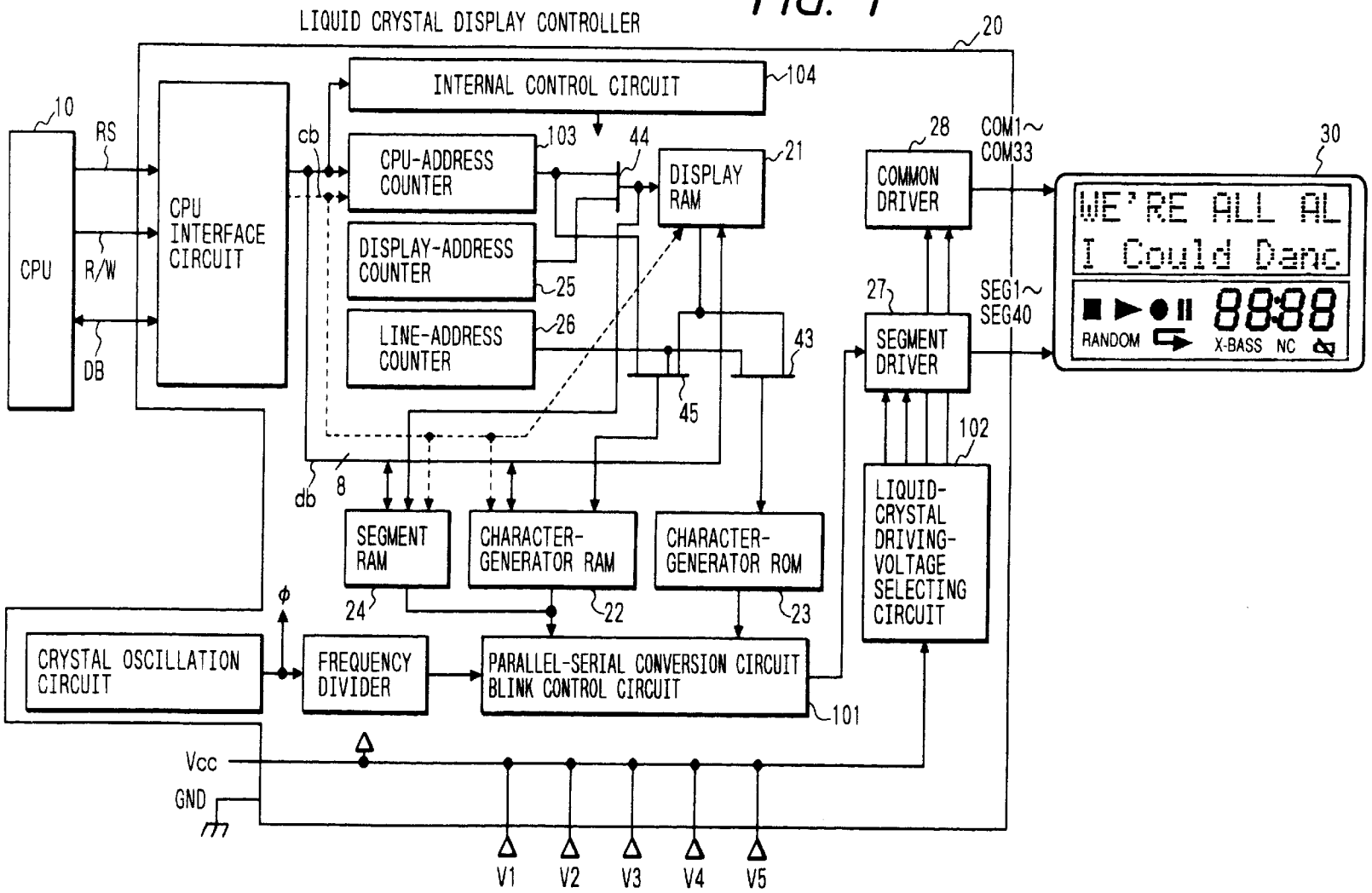
FIG. 1
LIQUID CRYSTAL DISPLAY CONTROLLER
20
30
WE'RE ALL ALL
I Could Dance
RANDOM
X-BASS
NC
COM1~COM33
SEG1~SEG40
28
COMMON DRIVER
27
SEGMENT DRIVER
102
LIQUID-CRYSTAL DRIVING-VOLTAGE SELECTING CIRCUIT
101
104
INTERNAL CONTROL CIRCUIT
21
DISPLAY RAM
43
45
44
103
CPU-ADDRESS COUNTER
25
DISPLAY-ADDRESS COUNTER
26
LINE-ADDRESS COUNTER
CHARACTER-GENERATOR ROM
23
CHARACTER-GENERATOR RAM
22
SEGMENT RAM
24
PARALLEL-SERIAL CONVERSION CIRCUIT BLINK CONTROL CIRCUIT
FREQUENCY DIVIDER
cb
8
db
CPU INTERFACE CIRCUIT
RS
R/W
DB
10
CPU
CRYSTAL OSCILLATION CIRCUIT
V1
V2
V3
V4
V5
Vcc
GND

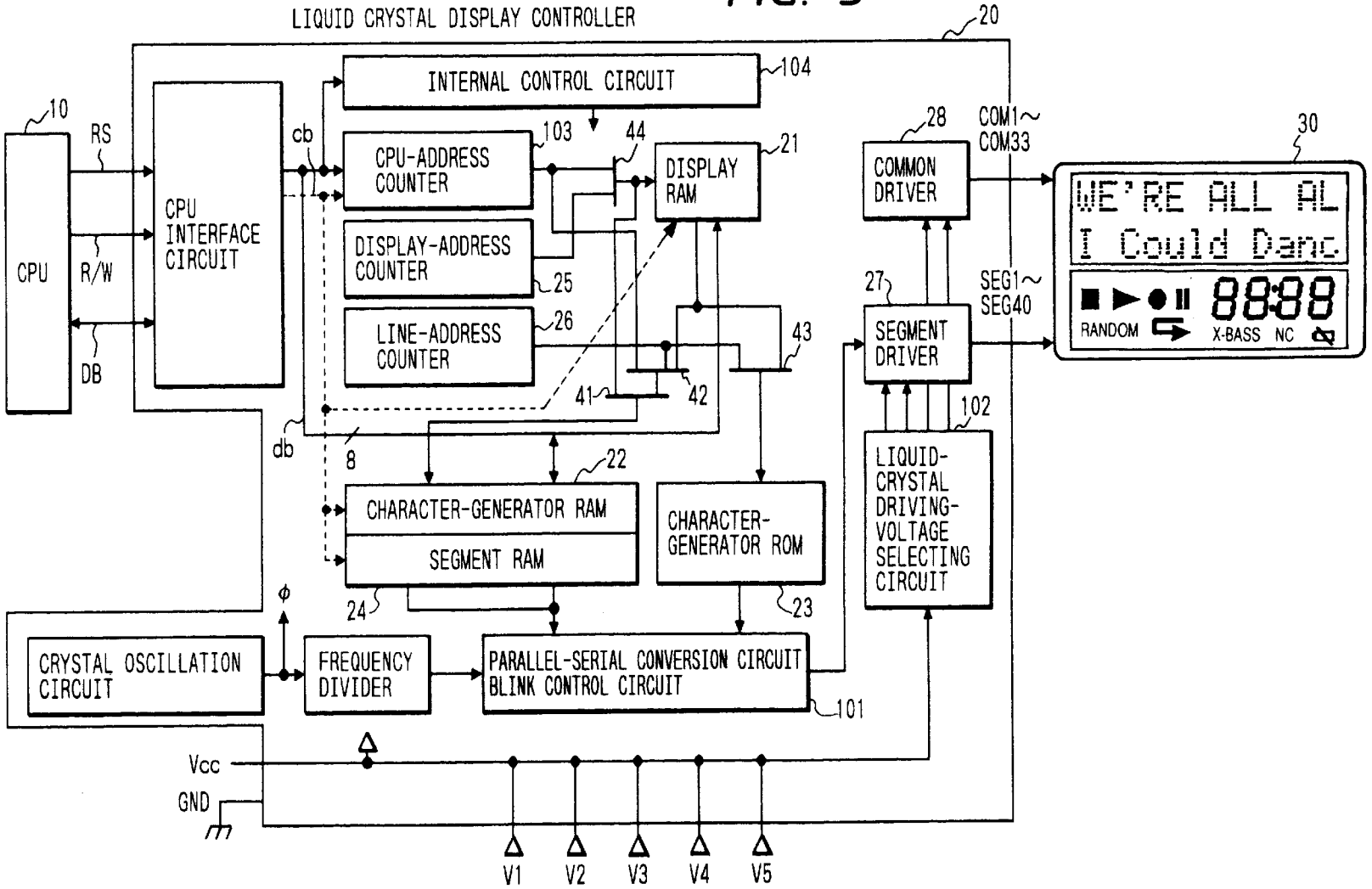
FIG. 3
LIQUID CRYSTAL DISPLAY CONTROLLER
20
30
WE'RE ALL AL
I Could Dance
RANDOM
X-BASS
NC
COM1~COM33
SEG1~SEG40
28
COMMON DRIVER
27
SEGMENT DRIVER
102
LIQUID-CRYSTAL DRIVING-VOLTAGE SELECTING CIRCUIT
101
104
INTERNAL CONTROL CIRCUIT
21
DISPLAY RAM
43
42
44
41
103
CPU-ADDRESS COUNTER
25
DISPLAY-ADDRESS COUNTER
26
LINE-ADDRESS COUNTER
23
CHARACTER-GENERATOR ROM
22
CHARACTER-GENERATOR RAM
SEGMENT RAM
24
PARALLEL-SERIAL CONVERSION CIRCUIT BLINK CONTROL CIRCUIT
FREQUENCY DIVIDER
CPU INTERFACE CIRCUIT
CRYSTAL OSCILLATION CIRCUIT
cb
db
8
φ
RS
R/W
DB
10
CPU
V1
V2
V3
V4
V5
Vcc
GND

LIQUID-CRYSTAL DISPLAY CONTROL APPARATUS

This is a continuation application of U.S. Ser. No. 09/369,121, filed Aug. 5, 1999; which is a continuation application of U.S. Ser. No. 08/932,033, filed Sep. 17, 1997; now U.S. Pat. No. 6,005,537, which is a File Wrapper Continuation of U.S. Ser. No. 08/308,830, filed Sep. 19, 1994, now abandoned; which is at a File Wrapper Continuation of U.S. Ser. No. 08/100,764, filed Aug. 2, 1993, now abandoned.

BACKGROUND OF THE INVENTION

The present invention relates in general to a display control technology and in particular to a technology well applicable to the liquid-crystal driving method such as a technology effectively usable in a display control circuit of a liquid-crystal driving apparatus for displaying dot-matrix characters.

The conventional liquid-crystal driving apparatus for displaying dot-matrix characters comprises a display RAM unit, referred to hereafter as a DDRAM unit, for storing character codes and character-generator RAM and ROM units, referred to hereafter as CGRAM and CGROM units respectively, for storing character font patterns. A CPU (Central Processing Unit) writes codes of characters for display use into DDRAM addresses which correspond to positions on a liquid-display screen. The CPU also writes any arbitrary font patterns into the CGRAM unit. An operation to control liquid-crystal display is carried out as follows. First of all, a liquid-crystal display controller reads out the code of a character stored in the DDRAM unit at an address corresponding to a display position. The code of a character read out from the DDRAM unit is then used as part of an address of the CGRAM or CGROM unit from which a character font pattern is finally read out for display. Accordingly, in order to display a picture pattern other than the dot-matrix characters such a mark or an icon, it is necessary in the case of this configuration to use part of the CGRAM or CGROM unit for dedicatedly storing picture patterns such as marks and icons. An example of a liquid-crystal driving apparatus, that incorporates CGRAM and CGROM if units, is the LCD-II made by Hitachi, Ltd. For details of the LCD-II, refer to the HD44780 on Pages 1 to 12 of the user's manual which was published in February 1984.

SUMMARY OF THE INVENTION

As the number of picture patterns such as marks and icons increases, however, the sizes of the portions of the CGRAM and CGROM units required for storing the picture patterns such as marks and icons also increase as well. As a result, the portions of the CGRAM and CGROM units originally intended for storing font patterns of dot-matrix characters inevitably decrease. For example, in order to store 30 picture patterns such as marks and icons in a CGRAM unit of a liquid-crystal display controller, an area for storing font patterns of six 5×8-dot characters is required. Accordingly, if the capacity of the CGRAM unit is originally large enough only for storing font patterns of 8 characters, the number of dot-matrix characters, the font patterns of which can be stored in the remaining portion of the CGRAM unit, is reduced to 2. Therefore, the number of character font patterns that can be displayed at the same time is limited. As a result, the display control software becomes complicated.

In order to read out picture patterns such as marks and icons stored in the CGRAM and CGROM units, character codes are also required as well. It is thus necessary to write the required character codes in the DDRAM unit in advance. As a result, the picture patterns are difficult to use.

In addition, the conventional CGRAM and CGROM units are used for storing fonts in character units. Accordingly, display control cannot be carried out individually for a picture pattern that corresponds to a bit because information is not stored in bit units. For example, blink control cannot be done only for a particular picture pattern selected from a plurality of picture patterns stored at the same address in the CGRAM or CGROM unit.

The present invention addresses the problems described above. It is an object of the present invention to provide a liquid-crystal display controller for displaying picture patterns such as marks and icons in bit units independently of the display of dot-matrix characters.

Much like the conventional liquid-crystal driving apparatus described above, in order to display a in dot-matrix character, first of all, a character code is read out from a display-RAM unit which is accessed using a display address. Display addresses are generated one after another incrementally in accordance with display positions. The character code is then used in conjunction with a line address (raster address) for accessing a character-generator RAM unit or a character-generator ROM unit, from which a character font pattern is read out.

When displaying a particular line separately from the above operation, a display address is used for accessing a segment RAM unit, from which display/no-display information is read out. The display/no-display information read out from the segment RAM unit indicates whether or not a picture pattern such as an icon or a mark is to be displayed. As described above, display addresses are generated one after another in accordance with display positions.

The liquid-crystal driving operation for displaying character font patterns and the liquid-crystal driving operation for displaying picture patterns such as marks and icons are carried out on a time-division basis. Therefore, it is possible to display dot-matrix characters and picture patterns such as marks and icons on the same screen independently of the dot-matrix characters being displayed.

In addition to the aforementioned display/no-display information indicating whether or not a picture pattern such as a mark or an icon is to be displayed, information specifying display-control attributes such as blinking and black/white inversion can be stored for each mark and icon. A blinking attribute or the like for a particular picture pattern can thereby be selected from a plurality of pieces of mark/icon information stored at the same address in the segment RAM unit. It should be noted that the attribute information described above is an optional feature which is not absolutely required.

A liquid-crystal display apparatus provided by the present invention comprises a display RAM unit, character-generator RAM and ROM units and a segment RAM unit. Character codes are read out from the display RAM unit at addresses generated one after another incrementally in accordance with display positions. Character font patterns are read out from the character-generator RAM and ROM units locations specified by the character codes read out from the display RAM unit. On the other hand, the segment RAM unit is accessed directly by using the addresses generated one after another incrementally in accordance with display positions. Bit patterns read out from the segment RAM unit are used in the display control of picture patterns such as marks and icons. The character-generator RAM and ROM units and the segment RAM unit are accessed for displaying characters and picture patterns such as marks and icons respectively at their display positions on a time-division basis. Therefore, it becomes possible to display dot-matrix characters as well as picture patterns such as marks and icons on the same screen independently of the dot-matrix characters being displayed.

In addition to the display/no-display information for specifying whether or not a picture pattern is to be displayed, attribute information describing a display method for each picture pattern can be included in the data read out from the segment RAM unit through direct accesses using addresses generated one after another incrementally in accordance with display positions. The additional information allows display control such as blinking individual marks and icons to be carried out.

BRIEF DESCRIPTION OF THE DRAWINGS

FIG. 1 shows an embodiment implementing a liquid-crystal display control system in accordance with the present invention;

FIG. 3 shows another embodiment implementing a liquid-crystal display control system having a configuration different from that shown in FIG. 1 in accordance with the present invention;

DESCRIPTION OF THE PREFERRED EMBODIMENTS

Figure 2:
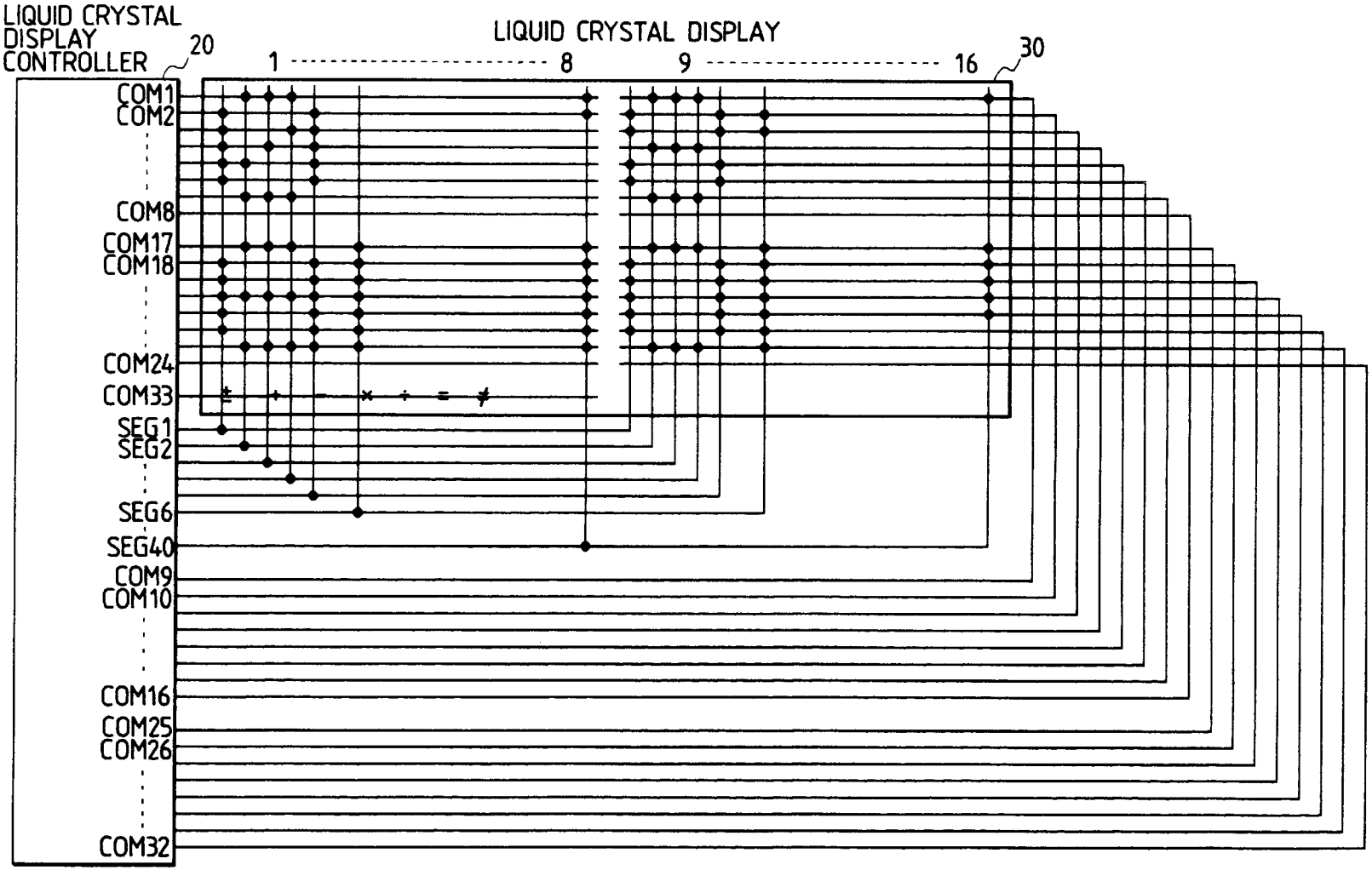
FIG. 2 shows a typical liquid-crystal display provided by the present invention.

FIG. 1 shows an embodiment implementing a liquid-crystal display control system in accordance with the present invention. As shown in the figure, the system comprises a CPU 10 for executing a display-control program, a liquid-crystal controller 20 controlled by instructions issued by the CPU 10 and a liquid-crystal display unit 30 controlled by the liquid-crystal controller 20. The liquid-crystal controller 20 is a single chip created on a semiconductor substrate made of syngle-crystal silicon by using a widely known semiconductor manufacturing technology. The liquid-crystal controller 20 comprises components embedded in the chip including a CPU interface circuit, a crystal-controlled oscillation circuit, a display RAM unit 21 for storing character codes, character-generator RAM and ROM units 22 and 23 for storing character font patterns and a segment RAM unit 24 for storing picture patterns such as marks and icons. The display RAM unit 21, the character-generator RAM and ROM units 22 and 23 and the segment RAM unit 24 are each allocated an address space. The address spaces allocated to the display RAM unit 21, the character-generator RAM and ROM units 22 and 23 and the segment RAM unit 24 are different from each other. The CPU 10 can freely update the contents of the display RAM unit 21, the character-generator RAM unit 22 and the segment RAM unit 24. The CPU 10 supplies a register-select signal RS, a read/write signal R/W and data to the CPU interface circuit. The register-select signal RS means selection (write in or read out) of a CPU address counter 103, at a low level. The register-select signal RS means selection (write in or read out) of the display RAM 21, the character-generator RAM 22 and the segment RAM 24, at a high level. Information conveyed by the register-select signal RS and the read/write signal R/W supplied to the CPU interface circuit is forwarded to each module through an internal control bus CB.

Let us take an operation to update data stored in the display RAM unit 21 as an example. First of all, the CPU 10 asserts the register-select signal RS at a low level, supplying it to the CPU interface circuit. As described before, the register-select signal RS is set at a low level to indicate that an address is about to be written into the CPU address counter 103. Then, data supplied by the CPU 10, a predetermined address in the display RAM unit 21, is loaded into the CPU address counter 103 through an external data bus DB, the CPU interface circuit and an internal data bus db. Next, the CPU 10 supplies the register-select signal RS at a high level and the read/write signal R/W at a low level to the CPU interface circuit to indicate a write mode for the RAM units. The CPU 10 then supplies information to an internal control circuit 104 through the external data bus DBs, the CPU interface circuit and the internal data bus db. Receiving the information from the CPU 10, the internal control circuit 104 requests an address multiplexer 44 to select the output of the CPU address counter 103 as its output. In this way, the predetermined display RAM address previously loaded into the CPU address counter 103 is supplied to the display RAM unit 21. Data is further supplied by the CPU 10 to the display RAM unit 21 through the external data bus DB, the CPU interface circuit and the internal data bus db. The data is written into the display RAM unit 21 at a location specified by the display RAM address received from the CPU address counter 103. This event marks the completion of the operation to update data stored in the display RAM unit 21.

Next, let us think of an operation to update data stored in the segment RAM unit 24. First of all, the CPU 10 asserts the register-select signal RS at a low level, supplying it to the CPU interface circuit as in the case of the operation to update data stored in the display RAM unit 21. As described before, the register-select signal RS is set at a low level to indicate that an address is about to be written into the CPU address counter 103. Then, an address in the segment RAM unit 24 is loaded into the CPU address counter 103 through the external data bus DB, the CPU interface circuit and the internal data bus db. Next, the CPU 10 supplies the register-select signal RS at a high level and the read/write signal R/W at a low level to the CPU interface circuit to indicate a write mode for the RAM units. The CPU 10 then supplies information to the internal control circuit 104 through the external to data bus DB, the CPU interface circuit and the internal data bus db. Receiving the information from the CPU 10, the internal control circuit 104 requests the address multiplexer 44 to select the output of the CPU address counter 103 as its output. In this way, the segment RAM address previously loaded into the CPU address counter 103 is supplied to the segment RAM unit 24. Data is further supplied by the CPU 10 to the segment RAM unit 24 through the external data bus DB, the CPU interface circuit and the internal data bus db. The data is written into the segment RAM unit 24 at a location specified by the segment RAM address received from the CPU address counter 103. This event marks the completion of the operation to update data stored in the segment RAM unit 24.

Finally, let us consider an operation to update data stored in the character-generator RAM unit 22. First of all, the CPU 10 asserts the register-select signal RS at a low level, supplying it to the CPU interface circuit as in the case of the operation to update data stored in the display RAM unit 21.

As described before, the register-select signal RS is set at a low level to indicate that an address is about to be written into the CPU address counter 103. Then, an address in the character-generator RAM unit 22 is loaded into the CPU address counter 103 through the external data bus DB, the CPU interface circuit and the internal data bus db. Next, the CPU 10 supplies the register-select signal RS at a high level and the read/write R/S signal at a low level to the CPU interface circuit to indicate a write mode for the RAM units. The CPU 10 then supplies information to the internal control circuit 104 through the external data bus DB, the CPU interface circuit and the internal data bus db. Receiving the information from the CPU 10, the internal control circuit 104 requests the address multiplexer 44 to select the output of the CPU address counter 103 as its output. In this way, the character-generator RAM address previously loaded into the CPU address counter 103 is supplied to the character-generator RAM unit 22.

Data is further supplied by the CPU 10 to the character-generator RAM unit 22 through the external data bus DB, the CPU interface circuit and the internal data bus db. The data is written into the character-generator RAM unit 22 at a location specified by the segment RAM address received from the CPU address counter 103. This event marks the completion of the operation to update to data stored in the character-generator RAM unit 22.

Based on a clock signal ϕ generated by the crystal-controlled oscillation circuit at a a predetermined frequency, a display-address counter 25 generates display addresses one after another incrementally in accordance with screen display positions. Also based on the clock signal ϕ generated by the crystal-controlled oscillation circuit at the predetermined frequency, on the other hand, a line-address counter 65 generates raster addresses one after another incrementally in accordance with the raster position of each character display being driven. When displaying a character, the following control is carried out. First of all, the internal control circuit 104 requests the address multipexer 44 to select a display RAM address generated by the display-address counter 25 as its output to be supplied to the display RAM unit 21. Receiving the display RAM address from the address multiplexer 44, the display RAM unit 21 outputs a character code. Then, address multiplexers 43 and 45 forward this character code along with a raster address generated by the line-address counter 26 as a display address. If the display-address is a character-generator RAM address, a character font pattern is read out from the character-generator RAM unit 22. If the display-address is a character-generator ROM address, however, a character font pattern is read out from the character-generator ROM unit 23 instead. The character a font pattern is then displayed. When displaying a picture pattern such as a mark or an icon, on the other hand, the following control is carried out. First of all, the internal control circuit 104 requests the address multiplexer 44 to select a segment RAM address generated by the display-address counter 25 as its output to be supplied to the segment RAM unit 24. Receiving the segment RAM address from the address multiplexer 44, the segment RAM unit 24 outputs display control information. Characters and picture patterns such as marks and icons are displayed on the same screen on a time-division basis. There is no special limitation on the size of the character font and the number of displayed characters ((the number of digits)×(the number of rows)).

Figure 5:
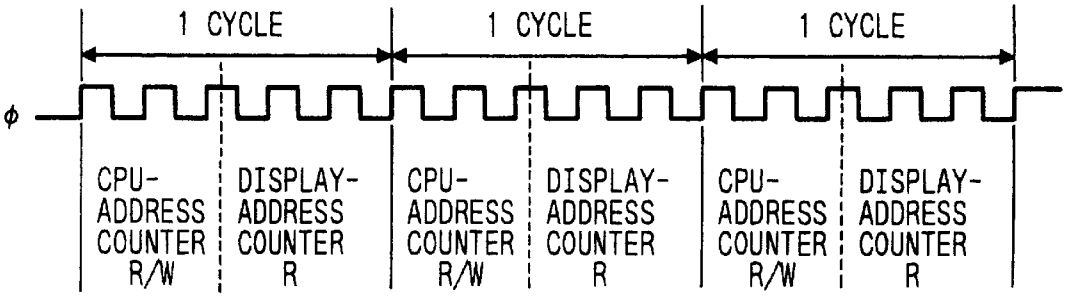
FIG. 5 is a time chart showing a state of operation in each cycle of a liquid-crystal display controller provided by the present invention.

The liquid-crystal display controller 20 provided by the present invention utilizes the clock signal ϕ generated by the embedded crystal-controlled oscillation circuit as a base clock signal. In accordance with the base clock signal, data is read out from and written into the display RAM unit 21, the character-generator RAM unit 22 and the segment RAM unit 24 at addresses output by the CPU address counter 103. In addition, data is also read out from and written into the display RAM unit 21, the character-generator RAM unit 22 and the segment RAM unit 24 at addresses output by the display-address counter 25. As shown in FIG. 5, a read operation at an address generated by the display-address counter 25 is carried out in the liquid-crystal controller provided by the present invention right after a read/write operation at an address output by the CPU address counter 103. A read operation at an address generated by the display-address counter 25 and a read/write operation at an address output by the CPU address counter 103 constitute a cycle.

In the display example shown in FIG. 2, a 5×8-dot character font is displayed in an ((8 digits)×(4 rows)) format. In the example shown in FIG. 2, in order to display 5×8-dot character fonts from 1st to 32nd lines on four rows, data is read out from the display RAM unit 21 and the character-generator RAM and ROM units 22 and 23. To be more specific, a character font pattern of 8 rasters for the first row is read out through the 1st to 8th lines. Similarly, character font patterns for the 2nd, 3rd and 4th rows are read out through the 9th to 16th lines, the 17th to 24th lines and the 25th to 32nd lines. In addition, in order to display a picture pattern such as a mark and an icon on the 33rd line, data is read out from the segment RAM unit 24. Display patterns read out from the character-generator RAM unit 22 or the character-generator ROM unit 23 and the segment RAM unit 24 are output by segment drivers 27 employed in the liquid-crystal display controller 20 shown in FIG. 1 on a time-division basis, to drive the liquid-crystal display unit 30. In the time-division based driving operation, driving lines are selected by common drivers 28 of the liquid-crystal display controller 20. In the example shown in FIG. 2, forty segment drivers 27 and thirty-three common drivers are employed, allowing a maximum of thirty-two 5×8-dot characters, corresponding to (8 digits×4 rows), and 40 different picture patterns such as marks and icons to be displayed.

The character-generator RAM unit 22 and the segment RAM unit 24 are shown in FIG. 1 as independent components. It should be noted, however, that both the units are accessed on a time-division basis and have address spaces different from each other as described earlier. Accordingly, the segment RAM unit 24 and the character-generator unit 22 can be implemented as a single RAM module with a contiguous address space for both. An embodiment of a liquid-crystal display controller 20 for such implementation is shown in FIG. 3. Also in this case, however, the address spaces are different from each other even though they may be contiguous and the single RAM module is accessed at addresses of the two different address spaces on a time-division basis. Driven by a control signal from an internal control circuit 104, an address multiplexer 41 switches from an access address to a read address accessed in a display operation or vice verse. By an access address, an address at which the CPU 10 accesses the character-generator RAM unit 22 or the segment RAM unit 24 is meant. For example, when the CPU 10 updates data stored in the character-generator RAM unit 22 or the segment RAM unit 24, the address multiplexer 41 selects an address for the character-generator RAM unit 22 or the segment RAM unit 24 generated by the CPU address counter 103 as its output supplied to the single RAM module. When the liquid-crystal display controller 20 displays data on the liquid-crystal display unit 30, on the other hand, the address multiplexer 41 forwards the output of the address multiplexer 42 to the single RAM module. When the liquid-crystal display controller 20 displays data on the liquid-crystal display unit 30, the address multiplexer 42 selects an address for reading the segment RAM unit 24 or an address for reading the character-generator RAM unit 22.

Figure 4:
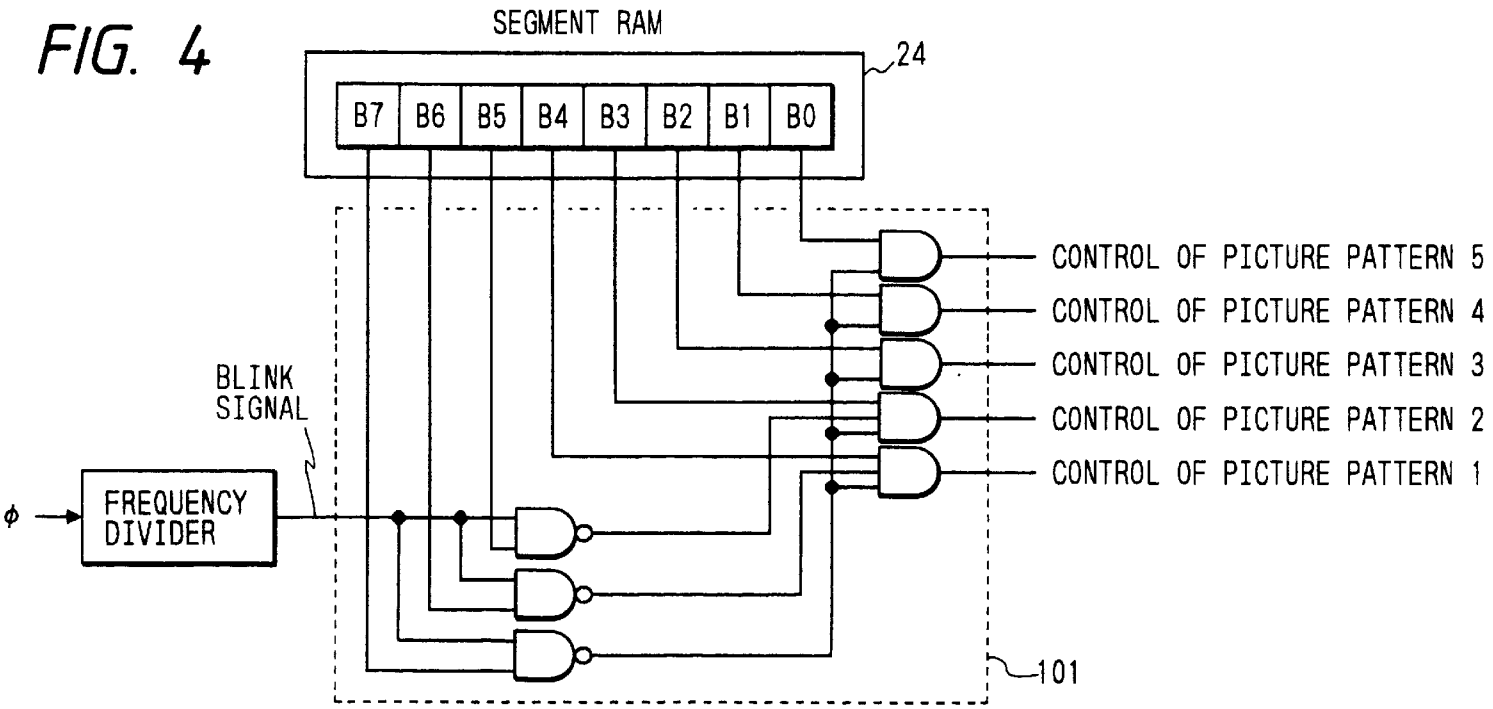
FIG. 4 shows a typical format of data stored in a segment RAM unit 24 provided by the present invention for displaying picture patterns such as marks and icons.

A typical data format in which picture patterns such as marks and icons are stored in the segment RAM unit 24 is shown in FIG. 4. Eight-bit display control information is stored in the segment RAM unit 24 at an address location. The low-order 5 bits, bit 0 to bit 4, of a piece of the display control information are a field for storing display/no-display information of five picture patterns such as marks and icons. Each bit indicates whether or not a picture pattern is to be turned on. Bit 7, the highest-order bit, represents attribute information which indicates that turned-on picture patterns of the five picture patterns of marks and icons are to be displayed in a blinking mode. Bits 6 and 5 are attribute information associated with picture patterns specified to be turned by bits 4 and 3 respectively. That is to say, bits 6 and 5 indicate that these picture patterns are to be displayed in a blinking mode if they are turned on. The blinking period is determined by a blinking signal which is obtained by dividing the frequency of the clock signal $\phi$ by means of a frequency divider.

According to the present invention, a segment RAM unit for storing picture patterns such as marks and icons is provided separately from character-generator RAM/ROM units for storing font patterns of dot-matrix characters as described above. Accordingly, the display of picture patterns such as marks and icons can be controlled in bit units. In addition, a liquid-crystal display unit is driven by data which is read out from the segment RAM unit and the character-generator RAM/ROM units on a time-division basis. As a result, it is possible to display font patterns of dot-matrix characters and picture patterns such as marks and icons on the same screen.

What is claimed is:

1. A liquid-crystal display controller formed on a semiconductor chip to be coupled to a liquid-crystal display unit having first common lines, a second common line, and segment lines arranged to cross said first common lines and said second common line, wherein first portions where the segment lines and the first common lines are overlapped have dots to be used for displaying character font patterns, and wherein second portions where the segment lines and the second common line are overlapped have predetermined picture patterns, the liquid-crystal display controller comprising:

a common line driver circuit which cyclically drives the first common lines and the second common line to be coupled;

a first memory which stores character codes to be displayed on the liquid-crystal display unit;

a character memory which is coupled to the first memory and which stores character font pattern information corresponding to the character codes stored in the first memory, the character memory being responsive to reception of a predetermined character code from said first memory and outputting predetermined character font pattern information corresponding to the predetermined character code;

a second memory which stores segment control information representing whether or not each of the predetermined picture patterns in the liquid-crystal display unit is displayed on the liquid-crystal display unit;

a segment line driver which is coupled to the character memory and to the second memory and which drives the segment lines in accordance with one of the segment control information from the segment memory and character font information from the character memory; and an address providing circuit which provides a display address to said first memory in synchronism with the driving of said first common lines while said display address is provided to said second memory in synchronism with the driving of said second common line.

2. A liquid-crystal display controller according to claim 1, wherein the second memory further stores blinking information indicating whether or not the predetermined picture patterns to be displayed are to be blinking.

3. A liquid-crystal display controller according claim 1, wherein the address providing circuit further includes a rewritable address providing circuit which provides a rewritable address indicating an address in the first memory and the second memory so as to rewrite one of the character codes stored in the first memory or the segment control information stored in the second memory.

4. A liquid-crystal display controller according to claim 3, wherein an address space of the first memory is different from that of the second memory.

5. A liquid-crystal display controller according to claim 1, wherein the segment line driver includes:

a parallel-serial converter which is coupled to receive the character font pattern information from the character memory and the segment control information from the second memory and converts the character font pattern information and the segment control information into serial information, and a segment driver which is coupled to receive the serial information and which drives the segment lines in accordance with the serial information.

6. A liquid-crystal display controller according to claim 1, wherein the character memory includes a read-only memory and a rewritable memory.

7. A liquid-crystal display controller according to claim 6, wherein the segment line driver includes:

a parallel-serial converter which is coupled to receive the character font pattern information from the character memory and the segment control information from the second memory and converts the character font pattern information and the segment control information into serial information, and a segment driver which is coupled to receive the serial information and which drives the segment lines in accordance with the serial information.

8. A liquid-crystal display controller according to claim 7, wherein the second memory further stores blinking to information indicating whether or not the predetermined picture patterns to be displayed are to be blinking.

9. A liquid-crystal display controller according to claim 8, wherein the address providing circuit further includes a rewritable address providing circuit which provides a rewritable address indicating an address in the first memory, the second memory and the rewritable memory and so as to rewrite one of the character codes stored in the first memory, the segment control information stored in the second memory and the character font pattern information stored in the rewritable memory.

10. A liquid-crystal display controller according to claim 9, wherein an address space of the first memory is different from that of the second memory.

11. A liquid-crystal display controller to be coupled to a CPU and to a liquid-crystal display unit, wherein the liquid-crystal display unit has a dot-matrix portion displaying character font patterns and a segment portion displaying predetermined picture patterns, wherein the dot-matrix portion has segment lines and first common lines, the segment lines and the first common lines in the dot-matrix portion being arranged to cross each other to form dots for the character font patterns, and wherein the segment portion segment lines and at least one second common line, the segment lines and the second common line in the segment portion being arranged to cross each other, the predetermined picture patterns being allocated at portions where the segment lines and the second common line in the segment portion are crossed, wherein the liquid-crystal display controller derives the first common lines and the second common line cyclically, the liquid-crystal display controller provides the segment lines with character font pattern information to be displayed on said dot-matrix portion and with control information indicating whether or not each of the predetermined picture patterns in the segment portion is displayed, the liquid-crystal display controller comprising:

a first memory storing therein character codes written by the CPU;

a character memory storing the character font pattern information, and outputting the corresponding character font pattern information to the segment lines in to response to an output of predetermined character codes from said first memory;

a second memory storing therein the control information written by the CPU; and an address output circuit providing first display addresses and second display addresses, wherein the first display addresses are provided to the first memory so as to read from the first memory the character codes of the character font patterns to be displayed on the dot-matrix portion so that the character memory is responsive to the character codes and provides the character font pattern information corresponding to the received character codes to the segment lines, wherein the second display addresses are provided to the second memory so as to read from the second memory the control information of the predetermined picture patterns to be displayed on the segment portion so that the second memory provides the control information to the segment lines, wherein the first display addresses are supplied to the first memory at a time when the character font patterns are displayed on the dot-matrix portion, and wherein the second display addresses are supplied to said second memory at a time when the predetermined picture patterns are displayed on said segment portion.

12. A liquid-crystal display controller according to claim 11, wherein the address output circuit further comprises a rewrite-address output circuit which generates a rewrite address indicating an address in the first memory or the second memory to change one of the character codes in the address of the first memory or one of the control information in the address of the second memory.

13. A liquid-crystal display controller according to claim 12, wherein an address space of the first memory is different from that of the second memory.

14. A liquid-crystal display controller according to claim 13, wherein the second memory further stores blinking information for indicating whether or not the predetermined picture patterns are to be displayed in a blinking mode.

15. A liquid-crystal display controller according to claim 14, further comprising:

a terminal to receive a clock signal having a predetermined frequency, wherein a period when a displayed predetermined picture pattern is blinking is determined by the clock signal.

16. A liquid-crystal display controller according to claim 15, further comprising:

a control circuit providing a control signal in response to information, provided from the CPU, which indicates to change one of the character codes in the first memory and the control information in the second memory; and a switch circuit coupled to the address outputting circuit and responsive to the control signal from the control circuit and providing to one of said first memory and said second memory the rewrite address from the rewrite-address output circuit instead of the first and the second display addresses from the address output circuit when the information is provided from the CPU to the control circuit.

17. A liquid-crystal display controller according to claim 11, wherein the character memory includes a rewritable memory.

18. A liquid-crystal display controller according to claim 17, wherein the address output circuit further comprises a rewrite-address output circuit generating a rewrite address indicating an address in the first memory, the character memory and the second memory to change one of the character codes in the first memory, the character font pattern information in the character memory and the control information in the second memory.

19. A liquid-crystal display controller according to claim 18, wherein the first memory, the character memory and the second memory have mutually different address spaces.

20. A liquid-crystal display controller according to claim 19, wherein the character memory further includes a read-only memory.

* * * * *